US006626252B1

(12) United States Patent
Kuckes

(10) Patent No.: US 6,626,252 B1
(45) Date of Patent: Sep. 30, 2003

(54) TWO SOLENOID GUIDE SYSTEM FOR HORIZONTAL BOREHOLES

(75) Inventor: Arthur F. Kuckes, Ithaca, NY (US)

(73) Assignee: Vector Magnetics LLC, Ithaca, NY (US)

( * ) Notice: Subject to any disclaimer, the term of this patent is extended or adjusted under 35 U.S.C. 154(b) by 21 days.

(21) Appl. No.: 10/114,280

(22) Filed: Apr. 3, 2002

(51) Int. Cl.[7] ..... E21B 47/024; E21B 7/04; G01V 3/08; G01V 3/18

(52) U.S. Cl. ..... 175/45; 175/61; 175/62; 324/346

(58) Field of Search ..... 175/45, 61, 62; 324/228, 232, 326, 346

(56) References Cited

U.S. PATENT DOCUMENTS 3,712,391 A 1/1973 Coyne
4,710,708 A 12/1987 Rorden et al.
4,875,014 A 10/1989 Roberts et al.
5,258,755 A * 11/1993 Kuckes ..... 175/45
5,485,089 A 1/1996 Kuckes
5,513,710 A 5/1996 Kuckes
5,589,775 A 12/1996 Kuckes
5,923,170 A 7/1999 Kuckes

* cited by examiner

*Primary Examiner*—David Bagnell
*Assistant Examiner*—Brian Halford
(74) *Attorney, Agent, or Firm*—Jones, Tullar & Cooper, P.C.

(57) ABSTRACT

An electromagnetic method and apparatus for directional drilling guidance of horizontal boreholes for the installation of pipelines and communication cables beneath rivers, highways and other obstacles is disclosed. A solenoid source, with horizontal axes, generates alternating electromagnetic fields which are measured in the borehole by a magnetometer with known orientation with respect to the direction of gravity near the drill bit. A preferred embodiment has a useable range of 150 meters from the source.

18 Claims, 9 Drawing Sheets

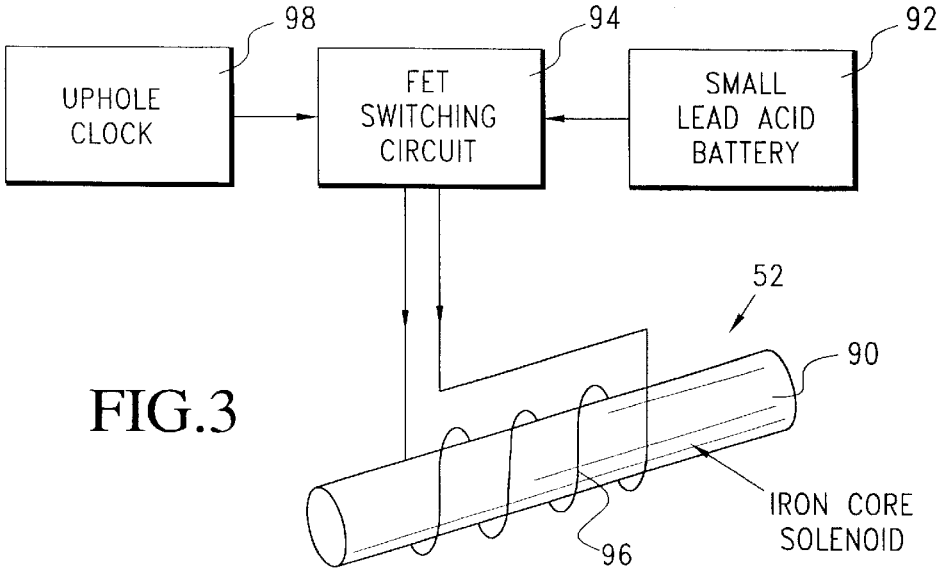
FIG.3
FIG.4(A)
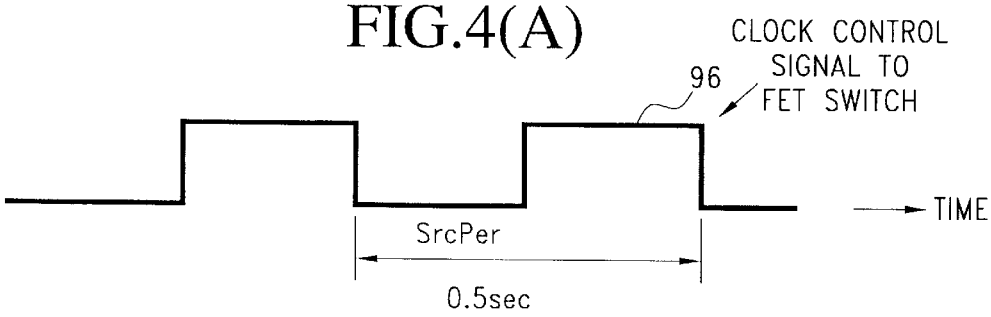
FIG.4(B)
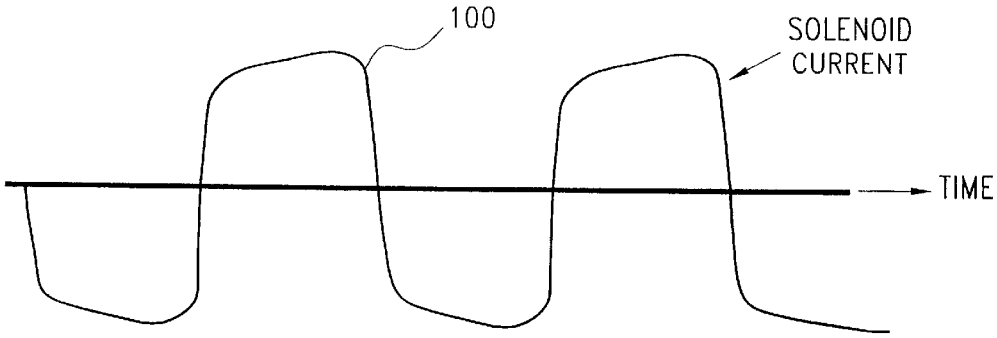

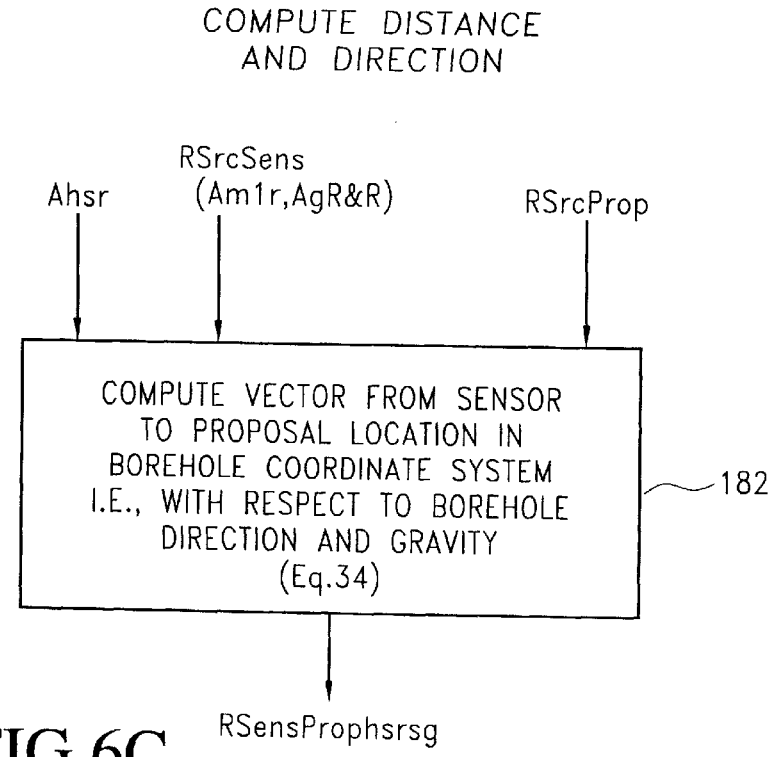
FIG.6C
FIG.7
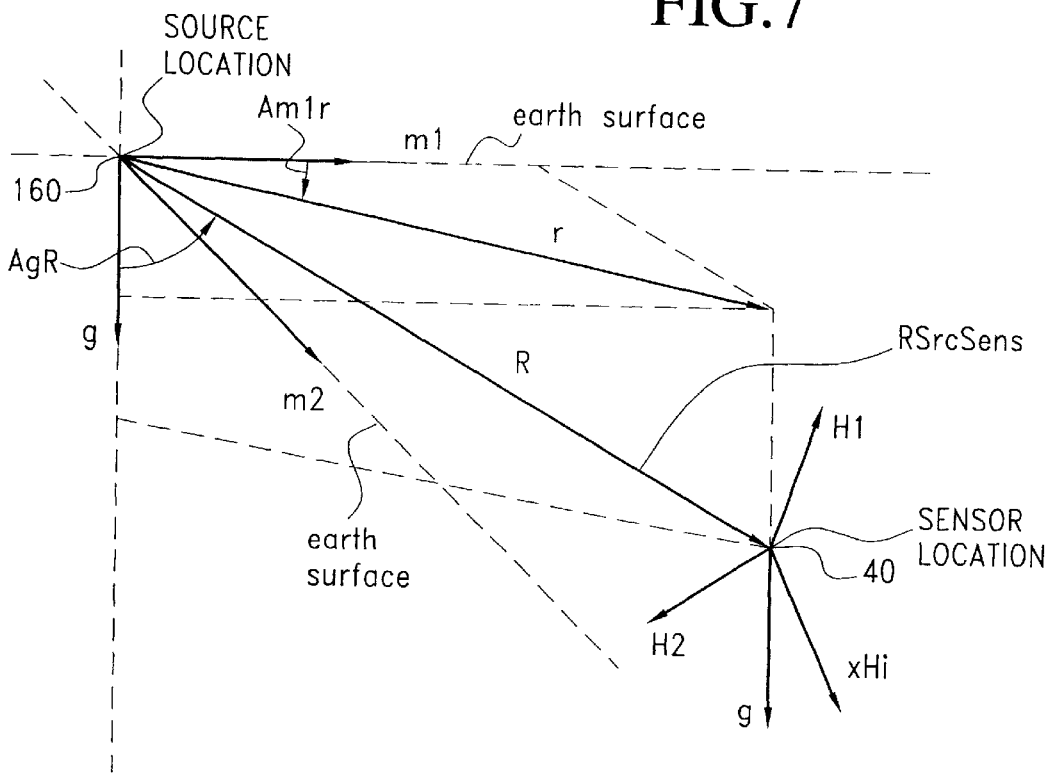

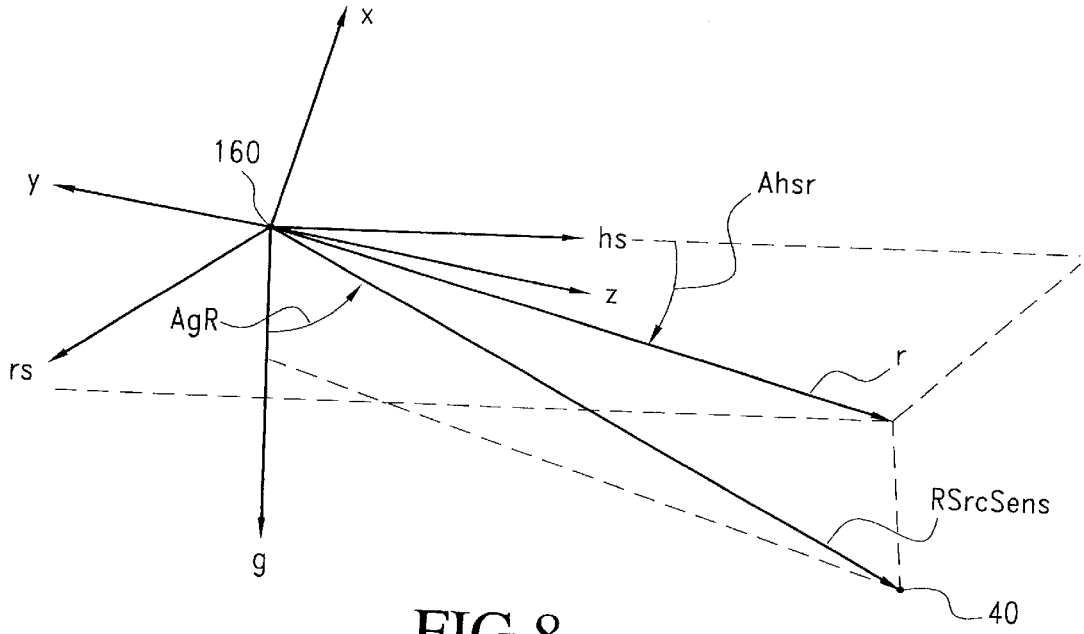
FIG.8
FIG.9
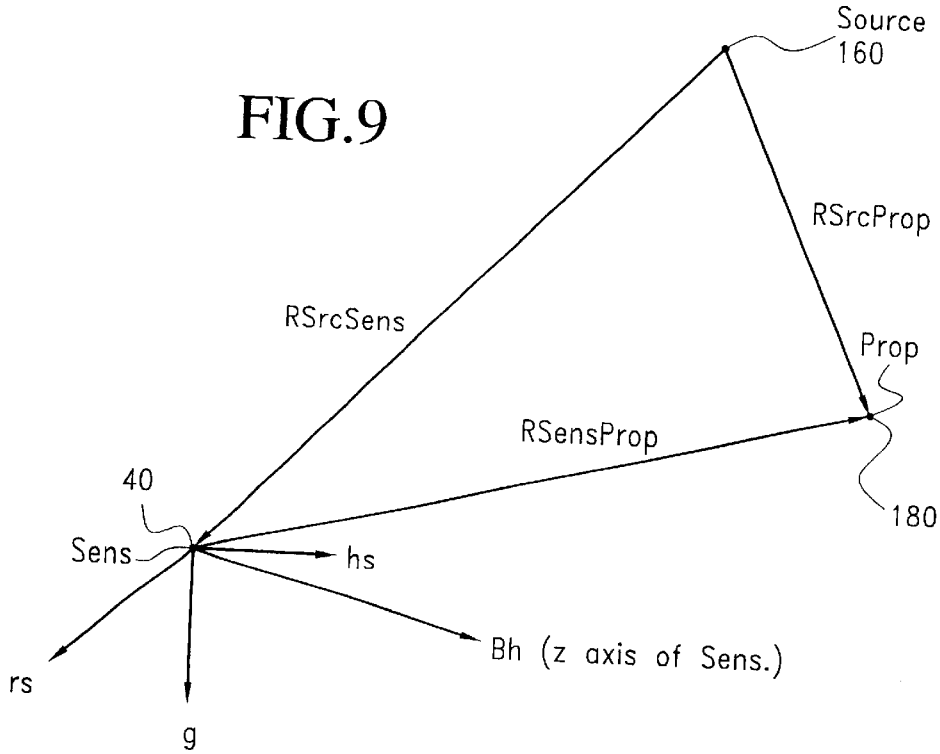

TWO SOLENOID GUIDE SYSTEM FOR HORIZONTAL BOREHOLES

BACKGROUND OF THE INVENTION

The present invention relates to a method and apparatus for tracking and guiding the drilling of a borehole, and more particularly to tracking a borehole being drilled generally horizontally under an obstacle such as a river, a highway, a railroad, or an airport runway, where access to the ground above the borehole is difficult or perhaps not possible.

Various well-known drilling techniques have been used in the placement of underground transmission lines, communication lines, pipelines, or the like through or beneath obstacles of various types. In order to traverse the obstacle, the borehole must be tunneled underneath the obstacle from an entry point on the Earth's surface to a desired exit point, the borehole then receiving a casing, for example, for use as a pipeline or for receiving cables for use as power transmission lines, communication lines, or the like. In the drilling of such boreholes, it is important to maintain them on a carefully controlled track following a prescribed drilling proposal, for often the borehole must remain within a right of way as it passes under the obstacle and its entry and exit points on opposite sides of the obstacle, must often be within precisely defined areas.

Prior systems, such as those illustrated in U.S. Pat. No. 4,875,014 issued to Roberts and Walters and U.S. Pat. No. 3,712,391 issued to Coyne, have provided guidance in the drilling of boreholes, but in some circumstances have presented problems to the user since they require access to the land above the path to be followed by the borehole to permit placement of surface grids or other guidance systems. Often, however, access to this land is not available; furthermore, the placement of guidance systems of this kind can be extremely time consuming, and thus expensive. The Earth's magnetic field is usually utilized for determining azimuthal direction, in such prior systems, but this creates additional problems because of the disturbances caused by nearby steel objects such as bridges, vehicular traffic and trains.

Other systems, typified by the system described in U.S. Pat. No. 4,710,708 to Rorden and Moore, provide to methods for guiding a drill in which the relative location of magnetic dipole transmitters with respect to magnetic field receivers is determined by measuring the magnetic field signals generated by the dipoles. In the system of this patent, for example, data is processed using unsynchronized clocks to derive amplitude and phase information from sinusoidally varying magnetic signals. These amplitude and relative phase signals are used to determine location and direction parameters of interest in a computational fitting procedure of successive approximation, using a gradient projection method. The application of this method to several configurations of practical interest is described in the '708 patent.

In addition, U.S. Pat. Nos. 5,485,089, 5,589,775 and 5,923,170 to Kuckes disclose methods for determining the lateral distance and orientation between substantially parallel boreholes using a solenoid powered by direct current together with an industry standard measurement while drilling (MWD) tool. U.S. Pat. No. 5,513,710 discloses a drilling guidance method for drilling boreholes under rivers and other obstacles using a direct current powered solenoid and an industry standard MWD system.

Although such prior systems are useful in various drilling guidance applications, it has been found that in many situations, increased precision and accuracy is needed.

SUMMARY OF THE INVENTION

The present invention is directed to an improved method and apparatus for providing guidance in drilling boreholes. The invention disclosed herein uses a localized electromagnetic source, which is oriented with respect to gravity, to generate magnetic fields. Vector components of this generated field are measured at a remote location with a system of sensors whose orientation with respect to the direction of gravity is known. The magnetic field measurements are analyzed mathematically to determine the azimuthal orientation of the sensors with respect to the azimuthal orientation of the source, and to determine the distance and inclination angle from the sensors to the magnetic field source.

The apparatus of the invention employs a magnetic field source that is oriented with respect to gravity and generates two mutually perpendicular, horizontal dipole magnetic fields whose polarity is periodically reversed by precise clock signals. Measuring instruments, also controlled by precise clock signals, at a remote location include three vector component alternating magnetic field sensors to measure the magnetic fields produced by the field source and three vector component gravity sensors to measure the direction of gravity relative to the measured vector components of the magnetic fields. Analysis of the magnetic field measurements gives a three dimensional sensor location with respect to the source location, and provides the azimuthal direction of the measuring instrument axes relative to the azimuthal direction of the magnetic dipole axes.

When the method of the invention is applied to drilling a borehole along a planned path, the measuring instrument package is deployed downhole, in the borehole and near the drill bit, as part of a measurement while drilling (MWD) assembly and the solenoid source is positioned at a known uphole location with respect to the planned borehole path, preferably on the Earth's surface above the path. After approximately every 10 meters of drilling, the drilling process conventionally is stopped to add a new segment of drill pipe. During this down period the required measurements and analysis required by the present invention can be carried out. This usually requires only a few minutes, during which time the solenoid source is powered in two perpendicular azimuthal orientations, the measurement data are gathered,and the measurements are analyzed. The distance and direction to the downhole instrument package and the orientation of the downhole coordinate system relative to the uphole coordinate system of the solenoid source are determined from the downhole magnetic field and gravity measurements. By comparing the measured location and orientation with the planned borehole trajectory specifications, up/down and left/right drilling direction adjustment recommendations for the next segment of drilling are provided to the driller at each measuring station. Tests at an industrial site with a system based upon the preferred embodiment disclosed herein gave useful results for drilling guidance out to a 150 meter spherical radius from the source location.

Although the invention will be described herein with respect to the drilling guidance of certain boreholes, various other applications of the disclosed method and apparatus will become apparent. For example, the system of the invention may be used in the precise determination of the paths of existing boreholes, the determination of locations in mines with reference to a surface location, or the relative location determinations which arise in tunnel construction. In certain applications, where only a few location and direction evaluations are required, enhanced range for the present system is readily provided by overnight or even longer signal averaging.

BRIEF DESCRIPTION OF THE DRAWINGS

The foregoing and additional objects, features and advantages of the present invention will be apparent to those of skill in the art from a consideration of the following detailed description of a preferred embodiment thereof, taken in conjunction with the accompanying drawings, in which:

FIG. 3 is a diagrammatic illustration showing the electronic circuitry configuration powering the solenoid source;

FIGS. 4A and 4B are diagrammatic illustrations showing the waveforms of the clock control signal and the solenoid current flow vs. time, respectively;

FIGS. 6A–6C are a flow diagram of the process of the present invention for computing the distance and direction from a field source to the measuring instruments;

FIG. 7 is a diagrammatic illustration showing the relationship of vector quantities which enter into the mathematical analysis of the fields;

FIG. 8 is a diagrammatic illustration of the vector relationships between the instrument package xyz coordinate system, the downhole hsrsg coordinate system, the drilling direction which is the z axis of the instrument package, and the location vectors RSrcSens and r;

FIG. 9 is a diagrammatic illustration of the vector relationships from the source to an arbitrary point on the proposal path.

DESCRIPTION OF PREFERRED EMBODIMENTS

Figure 1:
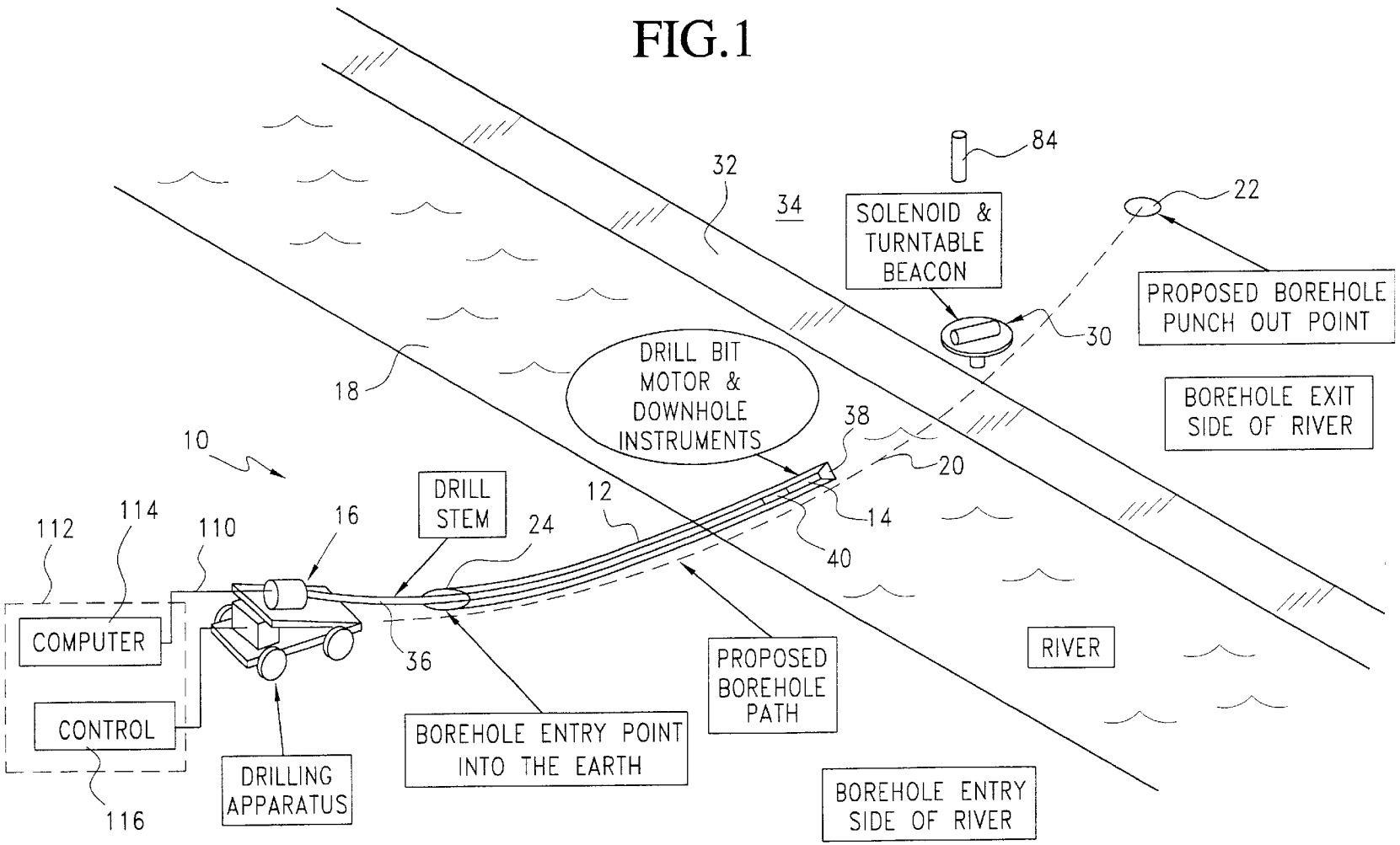
FIG. 1 is a diagrammatic illustration of a drill guidance system utilizing the invention for guiding the drilling of a horizontal borehole following a proposed path to a proposed punch out point.

One embodiment of the apparatus utilized in the method of the present invention in a borehole drilling application for the laying of pipeline under a river is illustrated at 10 in FIG. 1. A borehole 12 is illustrated as being drilled using an industry standard drilling motor 14 and drill rig 16. The crossing of river 18 may entail drilling along a planned path 20 at a depth of 20 meters, for example, to a planned exit location 22, which may be 1000 to 1500 meters away from a borehole entry point 24. A solenoid beacon 30 is shown at a river bank 32, which in this case is the exit side of the river, the beacon being energized to produce magnetic fields that will provide the information needed to guide the drilling at each measurement station under the river and subsequently under the earth's surface 34 as drilling progresses toward the proposed exit location 22. The drilling motor 14 is mounted on a drill stem 36 to drive drill bit 38, in conventional manner, with an instrument package 40, which includes a three component accelerometer to measure the direction of gravity and a three component magnetometer to measure alternating magnetic fields, mounted on the drill stem just above the drilling motor. These instruments may or may not be part of a conventional measurement while drilling (MWD) package.

Figure 2:
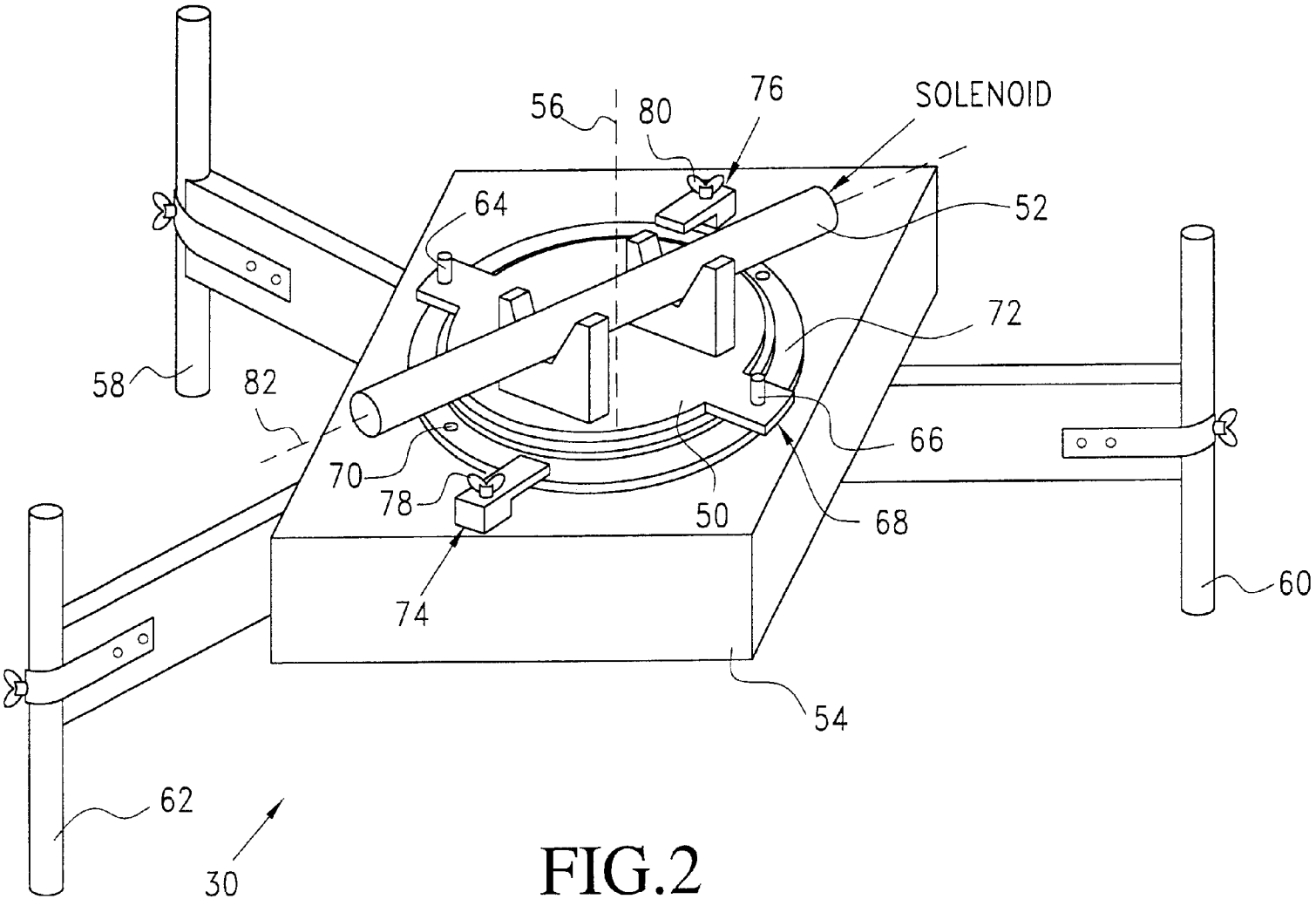
FIG. 2 is a diagrammatic illustration of a solenoid and turntable beacon showing provisions for setting the azimuthal orientation and for leveling the solenoid source.

The beacon source 30 is illustrated in greater detail in FIG. 2. In the preferred form of the invention, the beacon is positioned and oriented by land surveying techniques at a selected, known location with respect to the planned path 20 and exit location 22. The beacon may consist of a turntable 50 upon which a solenoid 52 is mounted. The turntable is mounted on a base 54 to rotate about an axis 56 made vertical by adjusting the lengths of base support legs 58, 60, 62 to thereby make the solenoid 52 horizontal at all azimuthal orientations as the turntable rotates. Any convenient method, such as the use of a spirit level, may be utilized for this purpose. The turntable can be set in two orientations perpendicular to each other by a pair of pins 64 and 66 at diametrically opposite locations on the turntable that fit into two pairs of holes 68 and 70 in an orientation ring 72 mounted on base 54. This ring can be rotated about the turntable axis 56 and clamped at any orientation by clamps 74 and 76. After the base 54 is leveled, the orientation of ring 72 is set by loosening clamping screws 78 and 80 on clamps 74 and 76, rotating the solenoid 52 while sighting along its axis 82 to make it point toward a surveyed reference location such as location 84 in FIG. 1, and tightening the clamp screws. The axes and the location of the beacon can thus be fixed by a simple, field-friendly procedure.

The solenoid 52 is illustrated in FIG. 3 as having a 23 kilogram laminated core 90 that, in a preferred embodiment, is 1.25 meters long. To provide the desired magnetic field, this solenoid may require 40 watts of power, for example, and this is supplied by a portable power supply such as a small, 12 volt lead acid battery 92 connected to a polarity reversing FET (field effect transistor) switch circuit 94 connected across the solenoid winding 96. The direction of electric current flow in the solenoid winding is periodically reversed by a reference square wave with a precise cycle period of 0.5 seconds derived from clock signals 96 (FIG. 4A) generated by a crystal oscillator 98 having a frequency that is precise to a few parts per million. The solenoid current vs. time waveform illustrated at 100 in FIG. 4B produces a magnetic dipole field of alternating polarity Although the principles of physics governing the behavior of the magnetic fields used in the analysis to be described are those appropriate to time independent magnetic fields, it is desirable to repeatedly reverse the direction of current flow in the solenoid to allow precise separation of the solenoid field from the Earth's magnetic field and from instrumental and magnetic field noise. It is also possible to simply turn the solenoid current on and off and to record the field differences. In this case the amplitude of the alternating polarity component of the magnetic dipole and field produced will be one half that produced if the current is reversed.

Figure 5:
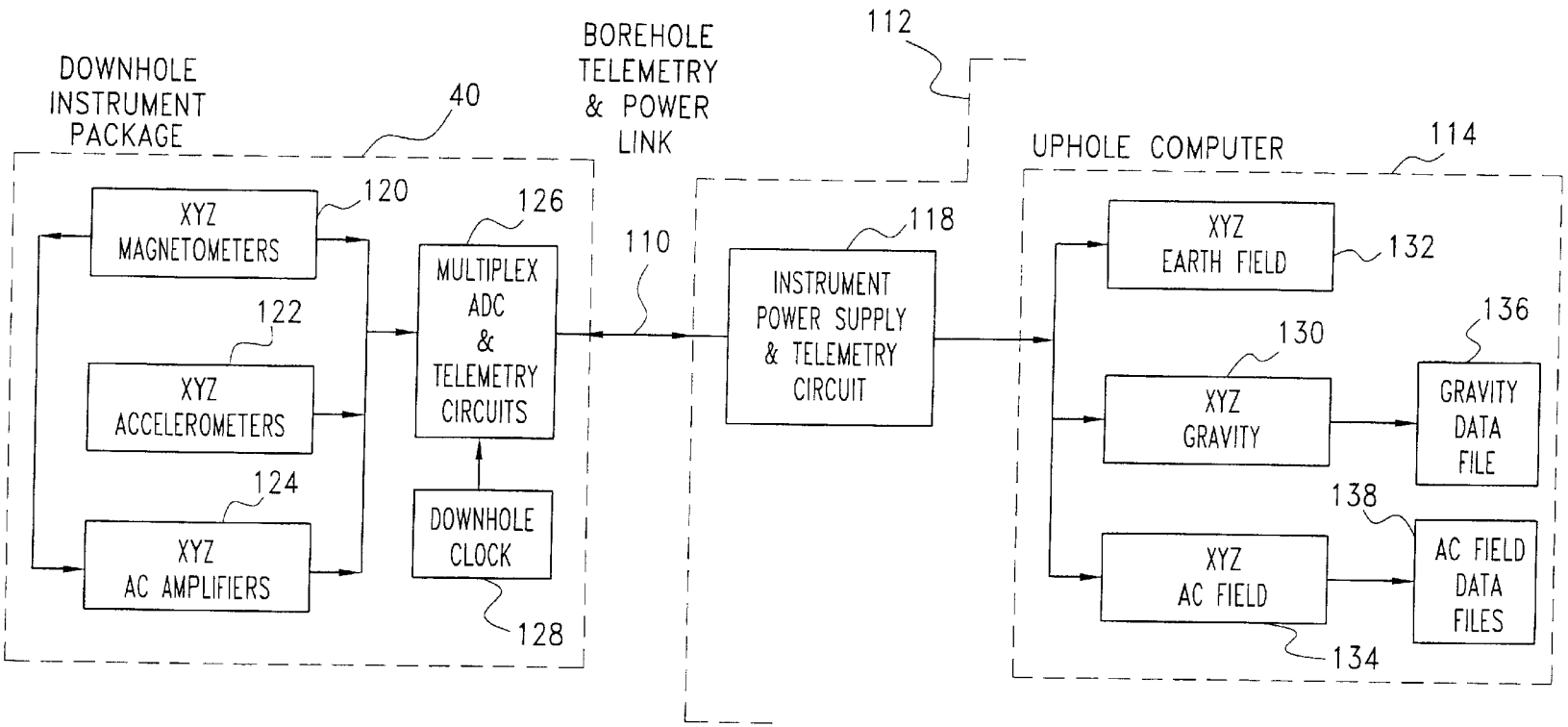
FIG. 5 is a diagrammatic illustration showing components of the alternating magnetic field and gravity measuring system.

A schematic diagram of the downhole measuring apparatus 40 is shown in FIG. 5 as being connected via a borehole telemetry link 110 to an uphole drilling control room 112 at the drilling rig 16 on the Earth's surface. The control room has a computer 114 for processing the data received from the downhole electronics and a controller 116 for operating the drill. A power supply 118 is connected via link 110 to power the down hole measuring instruments and telemetry circuits and to permit them to receive data from the instruments and convert the data to computer input signals. The power supply link may be a wire inside the drill stem 36 leading to the downhole instruments 40.

The downhole instrument package 40 includes a three vector component magnetometer 120 and a three vector component accelerometer 122, each of which generates output signals with respect to an xyz set of axes. The z axis of the instrument package 40 is aligned with the borehole 12 being drilled, and the perpendicular x and y axes have a known orientation alignment to the drill face; i.e., to the direction of a bent housing in the drilling motor which controls the direction of drilling. Direct current is received from the power supply 118 on the surface to power the instruments. The magnetometer AC outputs are passed through band pass amplifiers 124, and are multiplexed with the magnetometer DC outputs and the accelerometer outputs at multiplexer 126, where the signals are converted from analog to digital form and finally put into a form suitable for telemetry to the surface. The timing for digitization and telemetry is generated by a downhole clock 128 controlled by a quartz crystal whose frequency is precise to a few parts per million.

Data Acquisition and Processing

After drilling has been stopped at a measurement station along the proposed borehole path, the solenoid 52 is set to a first orientation, and energized as described with respect to FIG. 3. The resulting reversing field with an alternating polarity component is detected by magnetometers 120, the resulting output signals are transmitted uphole, a few minutes of data are recorded, and a data file is generated. The solenoid 52 is then set to a perpendicular orientation by rotating the turntable 90°, is energized to create a reversing field which is detected, a second set of data are recorded, and a second data file is generated. During each set of measurements the downhole multiplexer circuitry sequentially samples the output voltages of the magnetometers and the accelerometers at fixed time intervals and telemeters the results to the surface computer 114, which separates the gravity measurements at 130 from the Earth's field measurements at 132 and the AC field measurements at 134. The relative time at which each measurement is made is precisely preserved by the position it has in the serial data stream being telemetered, and the gravity data and AC field data are stored at data files 136 and 138, respectively. The computer 114 generates from the gravity data a single row, three column matrix gxyz with elements gx, gy and gz, which are the representation of the measured gravity g in the xyz coordinate system. From the magnetometer measurement data, two 3-column matrices h1 and h2 are generated. The first matrix hi has three columns h1x, h1y, and h1z which are tabulations of the time sequence of the digitized magnetometer measurement data from the first orientation of the solenoid. The second matrix h2 has three columns h2x, h2y, and h2z which are tabulations of the time sequence of magnetic field measurements from the second orientation of the solenoid.

Figure 6A:
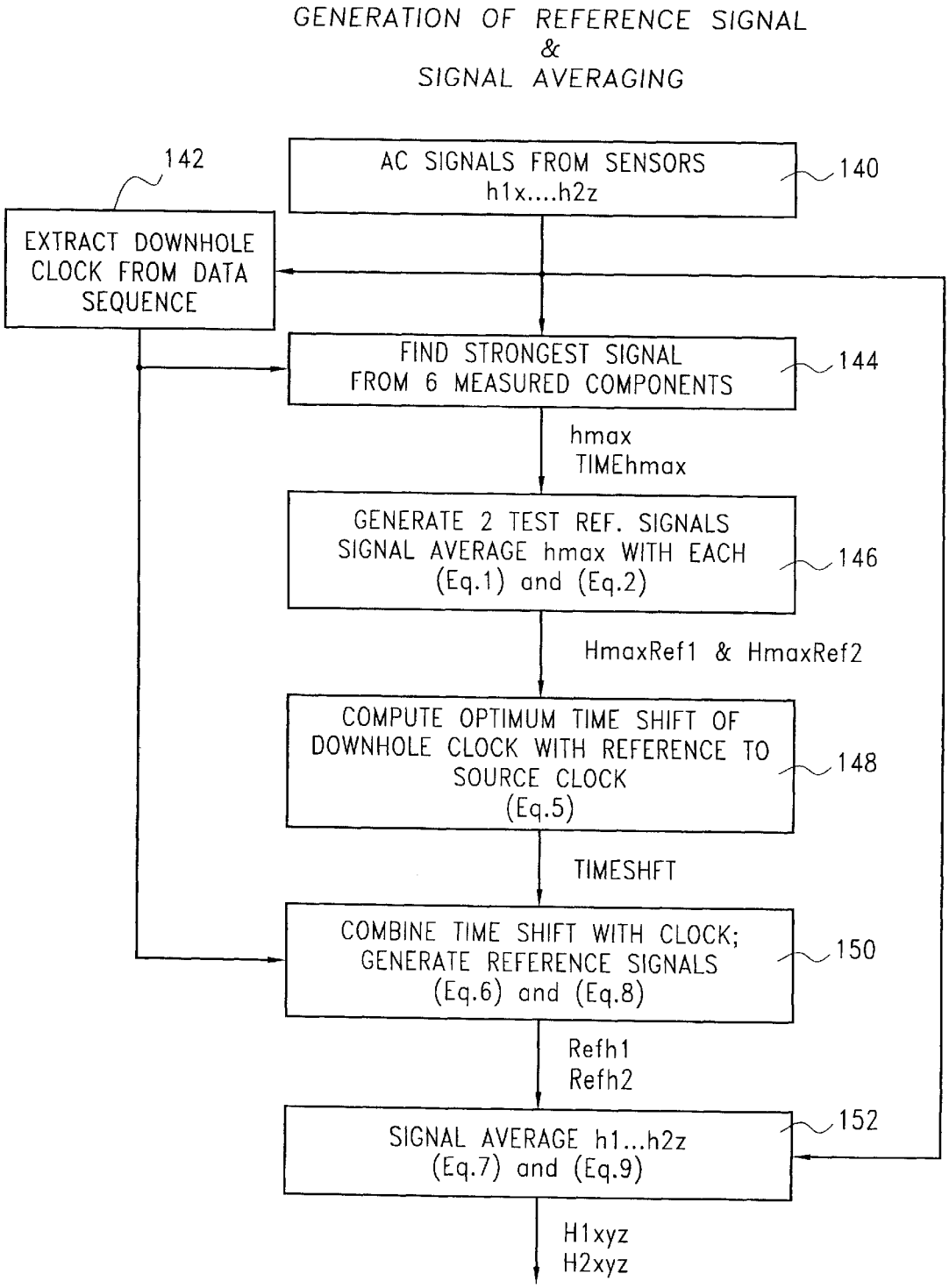
Figure 6B:
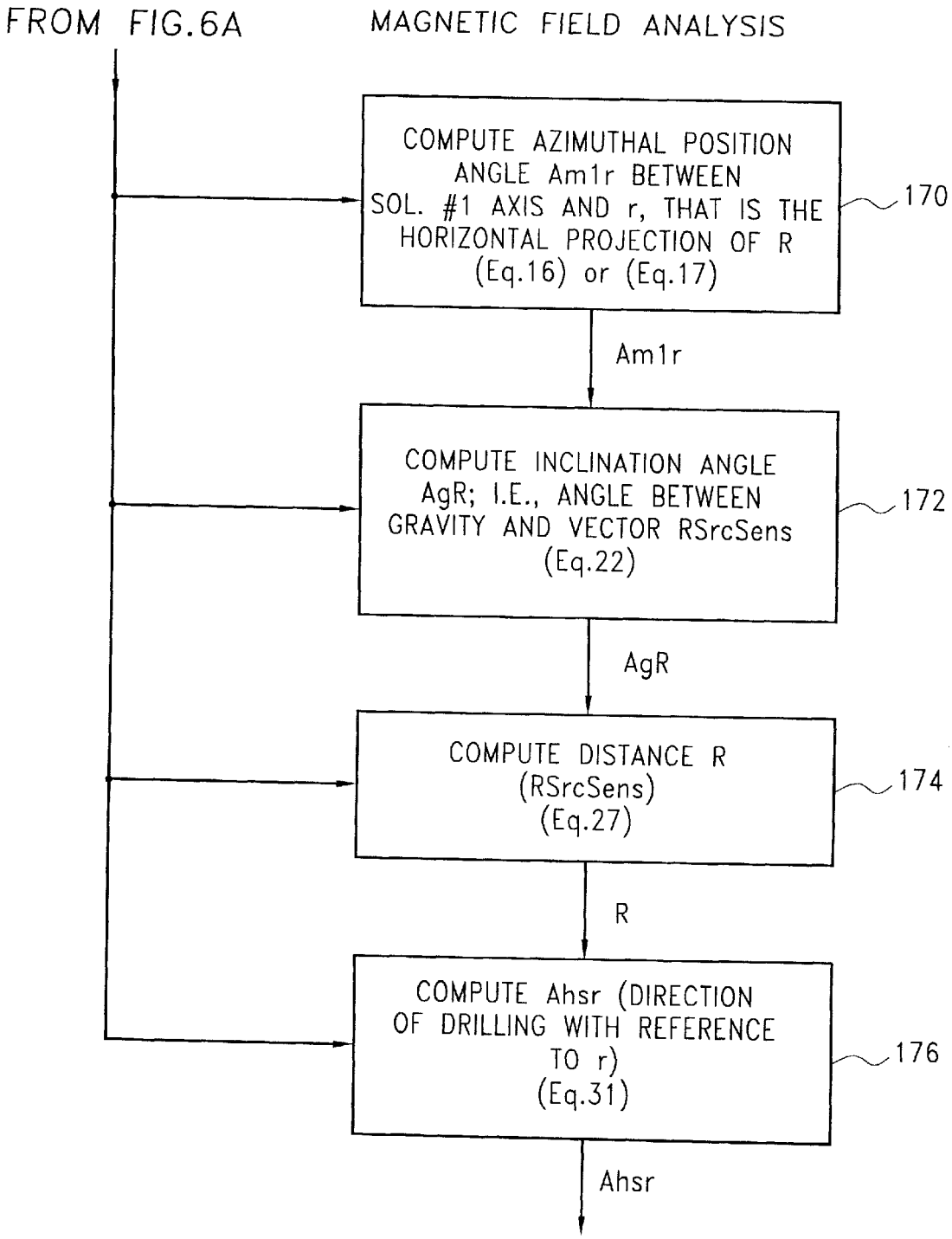
Figure 10:
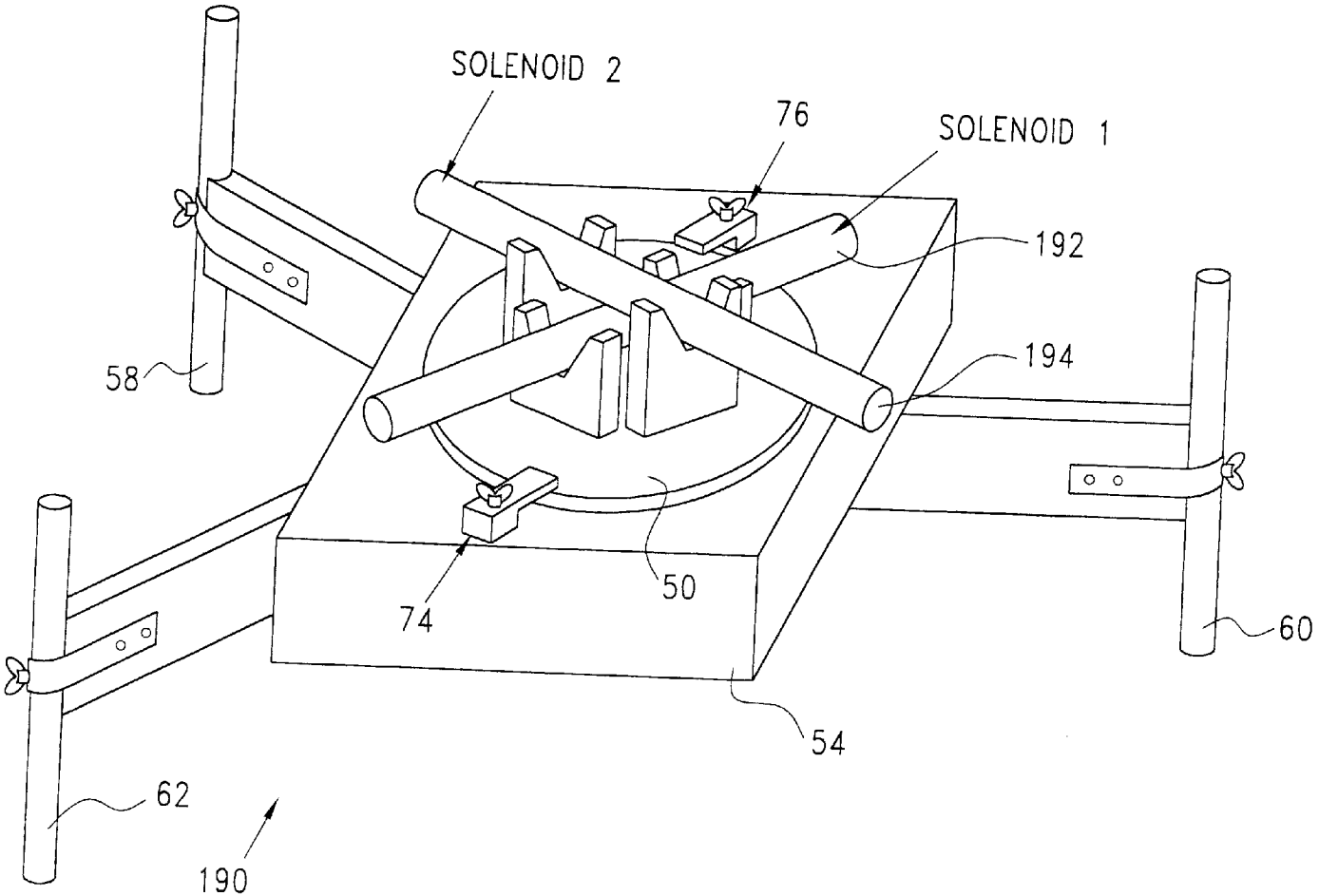
FIG. 10 is a diagrammatic illustration showing an alternative two solenoid source which allows simultaneous generation of the two dipole magnetic fields.

The first step for processing the recorded magnetic field data is the generation of a reference wave form which is time synchronized with the solenoid switching circuitry 94, as illustrated in FIGS. 6A–6C. For the apparatus disclosed herein, this time synchronization should be updated approximately once per hour; in practice it is convenient to do this at each measurement station. Signal averaging the magnetic field data matrices h1 and h2 with respect to this reference wave form produces two single row, three column matrices, H1xyz and H2xyz, of the time averaged solenoid vector magnetic field components. The first matrix has the elements H1x, H1y, and H1z, and the second has elements H2x, H2y, and H2z, which are the xy and z vector components of the two generated solenoid fields. H1xyz and H2xyz are xyz coordinate system representations of the field vectors measured. In general, the digital signal averaging computation method applied to the measured magnetic field components has a one-to-one correspondence to a method using an analog lockin amplifier (for example an Ithaco model 3962). A lockin amplifier passes the input voltage signal through a band pass filter (functionally similar to the downhole band pass amplifiers 124), multiplies the filtered signal with a time synchronized reference voltage waveform and averages the resulting voltage. The time average of randomly varying noise thus processed goes to zero after a long enough time, whereas the true signal component, which is synchronized with the reference waveform, produces a DC output proportional to the desired signal component. The reference waveform which is multiplied with the signal must have good time and polarity correlation with that of the signal. The lockin amplifier incorporates circuitry to generate this reference wave form from a user-supplied input reference voltage which has periodic rising or falling edges which have precisely the same period as the signal source excitation, i.e. the same period as the square wave controlling the solenoid current. To obtain optimum time overlap correlation between the signal and reference waveform, a manual adjustment is provided to adjust the time delay between the reference voltage edges supplied and the symmetric reference waveform generated by the instrument. A good procedure for making this adjustment is to process a strong, representative signal while adjusting the time shift to maximize the averaged output. This time shift adjustment and reference input are then left fixed and the signals of interest processed.

Generation of Reference Signal and Signal Averaging

More particularly, and as illustrated in the flow diagram of FIGS. 6A–6C, the first part of the digital procedure includes generating in computer 114 a symmetric reference waveform which is time-synchronized with the uphole solenoid source 52. As illustrated in FIG. 6A, the signals (block 140) detected by magnetometers 120 and accelerometers 122 and supplied to computer 114 are processed at block 142 to extract the clock signals of downhole clock 128 from the data sequence being transmitted. To determine an optimal time shift from the signals 140 at a given measuring station, the strongest signal of the six magnetic field vector components is selected and processed (block 144) to find an optimal time shift. For this purpose, a reference waveform is defined, against which all six magnetic field components can be signal averaged. To choose the magnetic field components with the strongest signal, the average square of the six data columns, h1x, h1y . . . h2z, is computed, using the MATLAB function "mean" to perform the operations mean (h1. *h1) and mean(h2. *h2). From the six numbers thus found, the largest defines a column matrix of data, called hmax. The serial telemetry data stream locations assign a time to each of the measurements of hmax, and those times are put into a single column matrix called Timehmax. The functional form of the reference wave form to be used is cos(w*t), where w is the fundamental radian frequency of the source, i.e., w=2*pi/SrcPer, where SrcPer is the source period; i.e., 0.5 seconds.

Two single column reference test matrices are defined as Reftest1 and Reftest2, as illustrated in FIG. 6A at block 146:

$$\text{RefTest}\mathbf{1}=\cos(w*\text{Timehmax}) \quad \text{(Eq. 1)}$$

$$\text{Reftest}\mathbf{2}=\cos(w*(\text{Timehmax-SrcPer}/4)) \quad \text{(Eq. 2)}$$

RefTest1 is a single column matrix evaluating cos(w*t) at the times Timehmax; i.e., the times at which the measurements of hmax were made according to the downhole clock.

RefTest2 is a second cosine reference wave form evaluated at times shifted by a quarter of the time period of the solenoid clock from RefTest1. Passing hmax through a "digital lockin", first with reference function RefTest1 and then with RefTest2, means doing the two following evaluations $$\text{HMaxRef1}=2*\text{mean}(\text{RefTest1}.*\text{hmax}) \quad \text{(Eq. 3)}$$

$$\text{HMaxRef2}=2*\text{mean}(\text{RefTest2}.*\text{hmax}) \quad \text{(Eq. 4)}$$

A multiplication by 2 has been included in these definitions because the average value of (cos(w*t))^2=½. The optimum time shift (TimeShft) indicated by these two choices of the reference functions RefTest1 and RefTest2 is computed (block 148 of FIG. 6A):

$$\text{TimeShft}=(\text{SrcPer}/(2*pi))*a\ tan\ 2(\text{HMaxRefTest1},\ \text{HMaxRefTest2}) \quad \text{(Eq. 5)}$$

where a tan2 is the MATLAB 4 quadrant inverse tangent function.

As illustrated at block 150, all six columns of the data are now signal averaged with respect to a cos(w*t) reference function with this time shift. The 3-column measurement matrix h1 of field measurements at solenoid orientation 1, has an associated 3-column time matrix Timeh1, giving the times at which each of the measurement values of the three column matrix h1 was performed according to the downhole clock. The time shifted reference function is given and signal averaged field vector components (block 152) are given by:

$$\text{Refh1}=\cos(w*(\text{Timeh1}-\text{TimeShft}) \quad \text{(Eq. 6)}$$

$$H1xyz=2*\text{mean}(\text{Refh1}.*h1) \quad \text{(Eq. 7)}$$

Likewise, the measurements at solenoid orientation 2 are signal averaged with the same reference function with the same time shift i.e.:

$$\text{Refh2}=\cos(w*\text{Timeh2}-\text{TimeShft}) \quad \text{(Eq. 8)}$$

$$H2xyz=2*\text{mean}(\text{Refh2}.*h2) \quad \text{(Eq. 9)}$$

H1xyz and H2xyz, the AC magnetic field data from the two positions of the solenoid, are each one row, 3-column matrices giving signal averaged values of h1x, h1y h1z and h2x, h2y and h2z with respect to the time shifted cosine reference function. H1xyz and H2xyz are the amplitudes of the fundamental Fourier frequency component of the respective xyz vector components of h1 and h2. H1xyz and H2xyz are the representations of the magnetic field vectors H1 and H2 with respect to the xyz coordinate system defined by the instrument axes.

Use of a reference function of the form cos(w*t) in this manner gives the time projection of all the magnetic field vector component data onto a single reference function to give the signed cos(w*t) Fourier series amplitude of each vector component. This method of signal averaging does not give any relative phase information between the components which may be contained in the magnetic field measurement data.

Instead of generating time synchronization from the data, establishing direct time synchronization between the uphole and downhole clocks is sometimes the most appropriate method. This can be done by a wire or other telemetry link between the two sites. Alternatively, time signals can be derived from global positioning units or from WWV radio signals.

Magnetic Field Analysis

The notation and uphole configuration definitions for this analysis are shown in FIG. 7. At the Earth's surface 34, the two orientations for the solenoid 52 excitation, as illustrated by unit vectors m1 and m2 and these, together with the direction of the gravity unit vector g, define the surface coordinate system. RSrcSens is the vector from the origin 160 of the source coordinate system to the borehole sensors 40 near the drill bit and below the Earth's surface. The analysis begins by writing RSrcSens as a product of the magnitude of the vector R and a unit vector RUv, as follows:

$$\text{RSrcSens}=R*\text{RUv} \quad \text{(Eq.10)}$$

The lower case vector r is the projection of RSrcSens onto the horizontal plane of the Earth's surface, i.e., the plane of the vectors m1 and m2 as shown in FIG. 7.

Rm1m2g is the representation of RSrcSens in the m1, m2 and g coordinate system, as illustrated in FIG. 7, and gives:

$$Rm1m2g=R*(\sin(AgR)*\cos(Am1r)*m1+\sin(AgR)*\sin(Am1r)*m2+\cos(AgR)*g) \quad \text{(Eq. 11)}$$

The magnetic field vectors H1 and H2 at the sensors 40, generated by the solenoids m1 and m2, have strength m Ampere m^2. Maxwell's equations give the generated fields as:

$$H1=(m/(4*pi*R\hat{}3))*(3*\text{dot}(m1,RUv)*RUv-m1) \quad \text{(Eq. 12)}$$

$$H2=(m/(4*pi*R\hat{}3))*(3*\text{dot}(m2,RUv)*RUv-m2) \quad \text{(Eq. 13)}$$

The "dot" functions appearing in equations (12) and (13) return the vector dot product of its two vector arguments. There are two "azimuthal" angles Am1r, i.e., the angle between m1 and r (the horizontal projection of RSrcSens onto the horizontal plane) which give the same vectors H1 and H2. They are:

$$Am1r=0.5*a\ tan\ 2(2*\text{dot}(H1,H2),(\text{dot}(H1,H1)-\text{dot}(H2,H2)) \quad \text{(Eq. 14)}$$

or $$Am1r=0.5*a\ tan\ 2(2*\text{dot}(H1,H2),(\text{dot}(H1,H1)-\text{dot}(H2,H2))+pi \quad \text{(Eq. 15)}$$

Since the vector dot product of two vectors does not depend upon the coordinate system in which their representations are defined, the Am1r can be found from the field measurement results, i.e., $$Am1r=0.5*a\ tan\ 2(2*\text{dot}(H1xyz,H2xyz),(\text{dot}(H1xyz,H1xyz)-\text{dot}(H2xyz,H2xyz)) \quad \text{(Eq. 16)}$$

or $$Am1r=0.5*a\ tan\ 2(2*\text{dot}(H1xyz,H2xyz),(\text{dot}(H1xyz,H1xyz)-\text{dot}(H2xyz,H2xyz))+pi \quad \text{(Eq. 17)}$$

The quantities shown in Eq.16 and Eq.17 are computed from the data as indicated in block 170. The correct value of Am1r is chosen from a knowledge of the approximate azimuthal location of the sensor package with respect to the source location.

The horizontal unit vector in the direction of r, rUv, can be written as $$rUv=\cos(Am1r)*m1+\sin(Am1r)*m2 \quad \text{(Eq. 18)}$$

The inclination angle AgR, is computed, as illustrated at block 172, by forming the vector cross product of H1 and H2 (cross(H1,H2)) and dividing it by the total field quantity, dot(H1,H1)+dot(H2,H2) to give:

$$xH=\text{cross}(H1,H2)/(\text{dot}(H1,H1)+\text{dot}(H2,H2)) \quad \text{(Eq. 19)}$$

The vector xH lies in the plane of g and RSrcSens. To show this, compute cross (H1,H2) noting that m1, m2 and g form a right handed coordinate system. When dot(cross(RrcSens, xH) is computed using Eq.(11) for RrcSens, a null result is obtained. Thus, xH must lie in the plane defined by RsrcSens, and g.

It is useful to write xH in terms of two components. The first is the projection of xH onto g and the part of xH which is perpendicular to g. Since xH is in the plane of g and R, xH can be written as sum of two vectors, one in the rUv direction and a second in the g direction:

$$xH=xHr+xHg*g=magxHr*rUv+xHg*g \quad \text{(Eq. 20)}$$

where:

$$xHg=\text{dot}(xH,g)$$

$$xHr=xH-xHg*g$$

$$magxHr=mag(xHr) \quad \text{(Eq. 21)}$$

The MATLAB function "mag(A)" computes the magnitude of the vector A, which is sqrt(dot(A,A)). After some algebraic manipulation, the angle AgR can be written $$AgR=(½)*a\ \tan 2(6*magxHr,\ 7*xHg+1) \quad \text{(Eq. 22)}$$

Both xHg and magxHr are directly computable from the data, since the vector cross product and the vector dot product are both invariant to the coordinate systems of representation; that is:

$$xHxyz=\text{cross}(H1xyz,H2xyz)/(\text{dot}(H1xyz,H1xyz)+\text{dot}(H2xyz,H2xyz)) \quad \text{(Eq .23)}$$

$$xHg=\text{dot}(xHxyz,gxyz) \quad \text{(Eq. 24)}$$

$$xHrXyz=xHxyz-xHg*gxyz$$

$$magxHr=mag(xHxyz-xHg*gxyz) \quad \text{(Eq. 25)}$$

Thus, the angle AgR is computable from the measurements as noted in block 172.

Finally, as indicated in block 174, the distance R between the source and the sensor locations (RsreSens) can be related to the total field strength, as follows:

$$R=((m/(4*pi))\hat{}2*(½-(3/2)*\cos(2*AgR))/(\text{dot}(H1,H1)+\text{dot}(H2,H2))\hat{}(1/6) \quad \text{(Eq. 26)}$$

Again in terms of measurement representations of H1 and H2, R can be written as $$R=((m/(4*pi))\hat{}2*(½-(3/2)*\cos(2*AgR))/(\text{dot}(H1xyz,H1xyz)+\text{dot}(H2xyz,H2xyz))\hat{}(1/6) \quad \text{(Eq. 27)}$$

Thus, a systematic procedure has been disclosed to find from the measurement data the coordinate parameters of the vector RsrcSens; i.e., the distance R, the azimuth angle Am1r, and the inclination angle AgR.

Alternatively, the downhole coordinate system representation of RSrcSens may be called Rhsrsg, as illustrated in FIG. 8, wherein:

$$Rhsrsg=R*(\sin(AgR)*\cos(Ahsr)*hs+\sin(AgR)*\sin(Arsr)*rs+\cos(AgR)*g) \quad \text{(Eq. 28)}$$

To determine Rhsrsg, the downhole representation parameters of RSrcSens in terms of the downhole coordinate system, it is necessary to find only the angle Ahsr, as illustrated in block 176, since the angle AgR and R are the same in both representations. To find Ahsr (FIG. 8), it is useful to evaluate projections of xHr onto the hs and rs axes. To do this, the unit vector representations of hs and rs in the instrument xyz coordinate system must first be found. Since the borehole drilling direction is in the z direction, in the xyz system z=[0 0 1], it is possible to define rs and hs unit vectors as:

$$rs=\text{cross}(gxyz,\ [0\ 0\ 1])/\text{mag}(\text{cross}(gxyz,\ [0\ 0\ 1]) \quad \text{(Eq. 29)}$$

$$hs=\text{cross}(rs,gxyz) \quad \text{(Eq. 30)}$$

The rs unit vector is horizontal and perpendicular to the direction of drilling and points to the right side looking down the borehole. The hs unit vector is horizontal and perpendicular to both g and rs. If the borehole inclination, that is its angle with respect to gravity is less than 90 degrees then hs is on the high side of the borehole and in the plane of g and the borehole. The unit vector hs is the horizontal projection of the borehole direction.

The angle Ahsr can be found from the expression:

$$Ahsr=a\ \tan 2(\text{dot}(rs,xHrxyz),\text{dot}(hs,xHrxyz)) \quad \text{(Eq. 31)}$$

Thus, the parameters of Rhsrsg have also been found from the measurements.

Distance and Direction to Proposed Location

The planned drilling path, or proposal, is defined with respect to surface coordinates so that the vector RsrcProp (FIG. 9) from the source location 160 to an arbitrary location 180 on the proposal path 20 is readily written in terms of the m1m2g surface coordinate system (FIG. 7), from the solenoid source location site 160. The space vector from the sensor location 40 to a point 180 on the proposal RSensProp given by:

$$RSensProp=RSrcProp-RSrcSens \quad \text{(Eq. 32)}$$

All the coordinate quantities of RSensProp in the m1m2g coordinate system representation are thus known; that is, all the quantities in the equation:

$$RSensPropm1m2g=RSrcPropm1m2g-Rm1m2g \quad \text{(Eq. 33)}$$

are known. To guide further drilling, the vector from the sensors at the drill to a proposal point the coordinate quantities entering the down hole coordinate system representation, at sensor 40, illustrated in FIG. 9 as the hsrsg coordinate system of RsensProp, must be known. Since both the m1 m2g system of FIG. 7 and the hsrsg systems of FIG. 9 share the same g axis, the transformation from one system to the other is simply a rotation Rotm1m2gtohsrsg) about the g axis. The rotation angle is Am1hs=(Am1r-Ahsr). Thus noting that RSensPropm1m2g is a single row 3-column vector, and in MATLAB the transform of a matrix is denoted by "'", the vector may be computed, as indicated at block 182 in FIG. 6C, as follows:

$$RSensProphsrsg=(Rotm1m2gtohsrsg*RSensPropm1m2g')' \quad \text{(Eq. 34)}$$

$$Rotm1m2gtohsrsg=[\cos(Am1hs)\ \sin(Am1hs)\ 0;-\sin(Am1hs)\ \cos(Am1hs)\ 0;\ 0\ 0\ 1] \quad \text{(Eq. 35)}$$

The parameters RSensTghsrsg in the downhole coordinate system have been all related to the measured quantities. Thus the driller can be presented with the proposal location and the direction of this proposal location with respect to the present drilling location and the direction of drilling, from which the drill bit tool face can be set to make the necessary adjustment to drilling direction.

Both the location of the downhole sensors and their relationship to the source can be determined without making use of gravity measurements. This is implied by the observation that, from the six measurements discussed above; i.e., the three vector components of H1 and the three vector components of H2, it should be possible to determine the three vector components of the source location and the three quantities specifying the relative orientation of the downhole measurement system with respect to the source. Indeed, this computation is readily carried out. However, for a given precision of the magnetic field measurements the difference in precision of the computed quantities of interest is vastly different. The greatest improvement in accuracy is obtained by determining the vertical elevation of the borehole 12 relative to the source solenoids 52, which is of dominant interest, for the guidance of pipeline boreholes. For example, if the apparatus disclosed herein is used with the borehole sensor 40 located 10 meters below the Earth's surface at a radial distance of 100 meters from the source 52, with the measurements of H1 and H2 having +/−1% precision, the disclosed method yields an elevation of 10+/−0.7 meters. In contrast, using a purely electromagnetic method the useless value of 10+/−30 meters is found.

Determination of the right or left direction for this case, using the method disclosed, gives an expectation error of approximately ½ degree. This precision is better than can be expected operationally using conventional Earth magnetic field measurements. Allowing +/−2 degree errors in the location determination with a signal averaging time acceptable for drilling operations, the disclosed apparatus is useful at a range of about 150 meters.

An alternative source, which generates two independent dipole fields simultaneously, is illustrated at 190 in FIG. 9, wherein similar components carry the same identifying numerals as the apparatus of FIG. 2. Source 190 consists of two horizontal solenoids 192 and 194 mounted perpendicular to one another and supported on the turntable 50 rotatably supported by base 54 to allow the solenoid pair to be oriented with respect to a surveyed landmark. Once this apparatus is leveled and oriented at a selected source location it remains stationary until deployment at a new source location becomes necessary. The solenoids can be powered simultaneously, each by a power source similar to that shown in FIG. 3 but with different source time periods; for example, SrcPer1=0.4 seconds and SrcPer2=0.6 seconds. The data processing to evaluate the fields H1 and H2 generated in this way is similar to that disclosed above, except that only a single data file is obtained. It is first processed, as disclosed, looking for a signal with a period equal to SrcPer1 and then a second time looking for a signal with source period equal to SrcPer2. Such a source beacon has important advantages; it is amenable to remote, unmanned operation and for a given measurement precision less than ½ the drill rig down time is usually required to capture the required data.

Although the invention has been described in terms of preferred embodiments, variations and modifications may be made without departing from the true spirit and scope thereof, as set out in the following claims.

What is claimed is:

1. A method for drill guidance, comprising:

determining a planned path for a borehole;

positioning a localized magnetic field source having an axis with respect to said planned path;

orienting said field source axis with respect to gravity and with respect to a known azimuthal direction;

causing said source to generate first and second magnetic fields, each of said fields having an alternating polarity;

measuring, at a measurement location in a borehole being drilled, the vector components of said first and second magnetic fields and the vector components of gravity at the measurement location; and determining from vector components of first and second fields and said gravity vector components the distance and direction between the measurement location and the magnetic field source.

2. The method of claim 1, further including determining, from said vector components of said first and second magnetic fields and from said gravity vector components, the direction of the borehole being drilled.

3. The method of claim 1, further including:

determining from said distance and direction, and from the planned path of the borehole, the distance and direction from the measurement location to a point on the planned path of the borehole.

4. The method of claim 1, wherein said field source is a solenoid having an axis, and wherein orienting said field source axis includes leveling said solenoid to cause said solenoid axis to be oriented with respect to a horizontal plane.

5. A method of claim 4, wherein said solenoid is rotatable in said horizontal plane, and wherein generating first and second magnetic fields includes:

fixing said solenoid at a first rotational point and energizing said solenoid to generate said first magnetic field;

rotating said solenoid to a second rotational position substantially perpendicular to said first position; and energizing said solenoid to generate said second magnetic field.

6. The method of claim 5, wherein energizing said solenoid includes supplying to the solenoid a reversible current.

7. The method of claim 6, wherein energizing said solenoid includes reversing said current at a fixed rate.

8. If The method of claim 1, wherein said field source includes first and second mutually perpendicular solenoids each having an axis, and wherein orienting said field source axis includes leveling said solenoid axes with respect to a horizontal plane.

9. The method of claim 8, wherein generating said first and second magnetic fields includes energizing said first and second solenoids.

10. The method of claim 9, wherein energizing said first and second solenoids includes supplying to each solenoid a current whose direction reverses periodically.

11. The method of claim 10, wherein energizing said solenoids further includes reversing said current at a fixed rate.

12. The method of claim 1, wherein determining said distance and direction includes generating a reference waveform synchronized with said alternating polarity said magnetic fields and signal averaging the measured magnetic field vector components.

13. The method of claim 1, wherein determining said distance direction includes computing the inclination angle between said source location and said measurement location and computing therefrom the vector from said measurement location to a selected location on said planned path.

14. The method of claim 13, wherein determining said distance and direction further includes computing the azimuthal angle from said source axis to said measurement location.

15. The method of claim 13, further including determining from said distance and direction and from the planned path of the borehole the direction of drilling of the borehole.

16. The method of claim 1, wherein determining said distance and direction further includes computing the azimuthal angle from said source axis to said measurement location.

17. The method of claim 1, further includes determining from said distance and direction and from the planned path of the borehole, the direction of drilling the borehole.

18. The method of claim 1, wherein said field source includes first and second mutually perpendicular solenoids, each solenoid having an axis, and wherein orienting said field source axis includes leveling said solenoid axes with respect to a common horizontal plane, the method further including determining the direction of drilling said borehole from said distance and direction.

* * * * *